US010923832B2

(12) United States Patent
Fan et al.

(10) Patent No.: US 10,923,832 B2
(45) Date of Patent: Feb. 16, 2021

(54) CO-CONSTRUCTION ANTENNA MODULE

(71) Applicant: INPAQ TECHNOLOGY CO., LTD., Miaoli County (TW)

(72) Inventors: Chen-Kang Fan, Hsinchu (TW); Ta-Fu Cheng, Miaoli County (TW)

(73) Assignee: INPAQ TECHNOLOGY CO., LTD., Miaoli County (TW)

( * ) Notice: Subject to any disclaimer, the term of this patent is extended or adjusted under 35 U.S.C. 154(b) by 35 days.

(21) Appl. No.: 16/567,057

(22) Filed: Sep. 11, 2019

(65) Prior Publication Data

US 2020/0328534 A1 Oct. 15, 2020

(30) Foreign Application Priority Data

Apr. 10, 2019 (TW) ..... 108112511 A

(51) Int. Cl.

| | |
|---|---|
| ***H01Q 21/00*** | (2006.01) |
| ***H01Q 21/28*** | (2006.01) |
| ***H01Q 5/40*** | (2015.01) |
| *H01Q 1/24* | (2006.01) |

(52) U.S. Cl.
CPC ..... *H01Q 21/28* (2013.01); *H01Q 5/40* (2015.01); *H01Q 1/24* (2013.01)

(58) Field of Classification Search
CPC ..... H01Q 21/28; H01Q 5/40; H01Q 1/24; H01Q 5/42; H01Q 21/065; H01Q 21/062
USPC ..... 343/727
See application file for complete search history.

(56) References Cited

U.S. PATENT DOCUMENTS

| | | | | |
|---|---|---|---|---|
| 6,842,148 | B2 * | 1/2005 | Hendler | H01Q 1/38 343/702 |
| 9,806,422 | B2 * | 10/2017 | Garcia | G06K 19/07749 |
| 10,170,838 | B2 * | 1/2019 | Garcia | G06K 19/07749 |
| 10,431,892 | B2 * | 10/2019 | Garcia | G06K 19/077 |
| 2009/0295645 | A1 * | 12/2009 | Campero | H01Q 9/0407 343/700 MS |
| 2012/0275123 | A1 * | 11/2012 | de Rochemont | H01Q 15/0086 361/748 |
| 2014/0118203 | A1 * | 5/2014 | Sanford | H01Q 13/203 343/725 |
| 2016/0056544 | A1 * | 2/2016 | Garcia | H01Q 1/38 343/725 |
| 2017/0054197 | A1 * | 2/2017 | Ishikawa | H01Q 1/243 |
| 2017/0324135 | A1 * | 11/2017 | Blech | H01Q 13/02 |

(Continued)

*Primary Examiner* — Jean B Jeanglaude
(74) *Attorney, Agent, or Firm* — Li & Cai Intellectual Property (USA) Office

(57) ABSTRACT

A co-construction antenna module includes a carrier, a first patch antenna group, a second patch antenna group, a first dipole antenna group, and a second dipole antenna group. The carrier includes a first surface, a second surface relative to the first surface, and a surround surrounding side connected between the first surface and the second surface. The first patch antenna group includes a plurality of first patch antennas disposed on the carrier, and the plurality of first patch antennas are disposed on at least one of the first surface and the second surface. The second patch antenna group includes a plurality of second patch antennas disposed on the carrier, and the plurality of second patch antennas are disposed on at least one of the first surface and the second surface. The first dipole antenna group and the second antenna are disposed in the carrier.

10 Claims, 10 Drawing Sheets

(56) References Cited

U.S. PATENT DOCUMENTS

| | | | | |
|---|---|---|---|---|
| 2018/0212307 | A1* | 7/2018 | Kim | H01Q 21/065 |
| 2019/0252796 | A1* | 8/2019 | Mahanfar | H01Q 9/0428 |

* cited by examiner

CO-CONSTRUCTION ANTENNA MODULE

CROSS-REFERENCE TO RELATED PATENT APPLICATION

This application claims the benefit of priority to Taiwan Patent Application No. 108112511, filed on Apr. 10, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna module, and more particularly to a co-construction antenna module.

BACKGROUND OF THE DISCLOSURE

With the development of communication technology, various electronic products using wireless communication technologies have been created, such as mobile phones, wireless Internet devices, personal digital assistants and so on. Consumer requirements for the performance, design and size of these wireless communication devices are also increasing.

Although the related art discloses the architecture of a patch antenna and a dipole antenna, most the antenna structures of the related art can only provide a single frequency, have poor radiation efficiency.

SUMMARY OF THE DISCLOSURE

In response to the above-referenced technical inadequacies, the present disclosure provides a co-construction antenna module.

In one aspect, the present disclosure provides a co-construction antenna module including: a carrier, a first patch antenna group, a second patch antenna group, a first dipole antenna group, and a second dipole antenna group. The carrier includes a first surface, a second surface relative to the first surface, and a surrounding side connected between the first surface and the second surface. The first patch antenna group includes a plurality of first patch antennas disposed on the carrier, and the plurality of first patch antennas are disposed on at least one of the first surface and the second surface. The second patch antenna group includes a plurality of second patch antennas disposed on the carrier, and the plurality of second patch antennas are disposed on at least one of the first surface and the second surface. The first dipole antenna group is disposed in the carrier. The second dipole antenna group is disposed in the carrier. The first dipole antenna group is closer to the surrounding side than the first patch antenna group or the second patch antenna group, and the second dipole antenna group is closer to the surrounding side than the first patch antenna group or the second patch antenna group.

Therefore, the co-construction antenna module of the present disclosure has the technical features of "the plurality of first patch antennas being disposed on at least one of the first surface and the second surface," "the plurality of second patch antennas being disposed on at least one of the first surface and the second surface," and "the first dipole antenna group being closer to the surrounding side than the first patch antenna group or the second patch antenna group, and the second dipole antenna group being closer to the surrounding side than the first patch antenna group or the second patch antenna group" so as to improve the radiation efficiency of the antenna.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
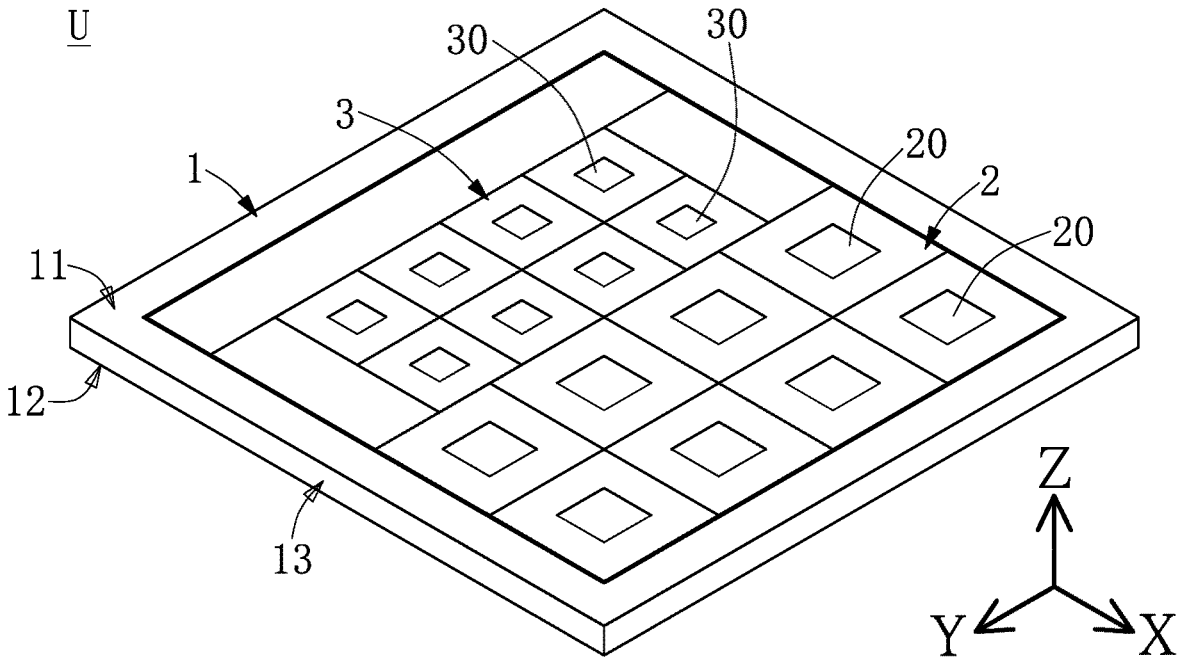
FIG. 1 is a perspective schematic view of a co-construction antenna module according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
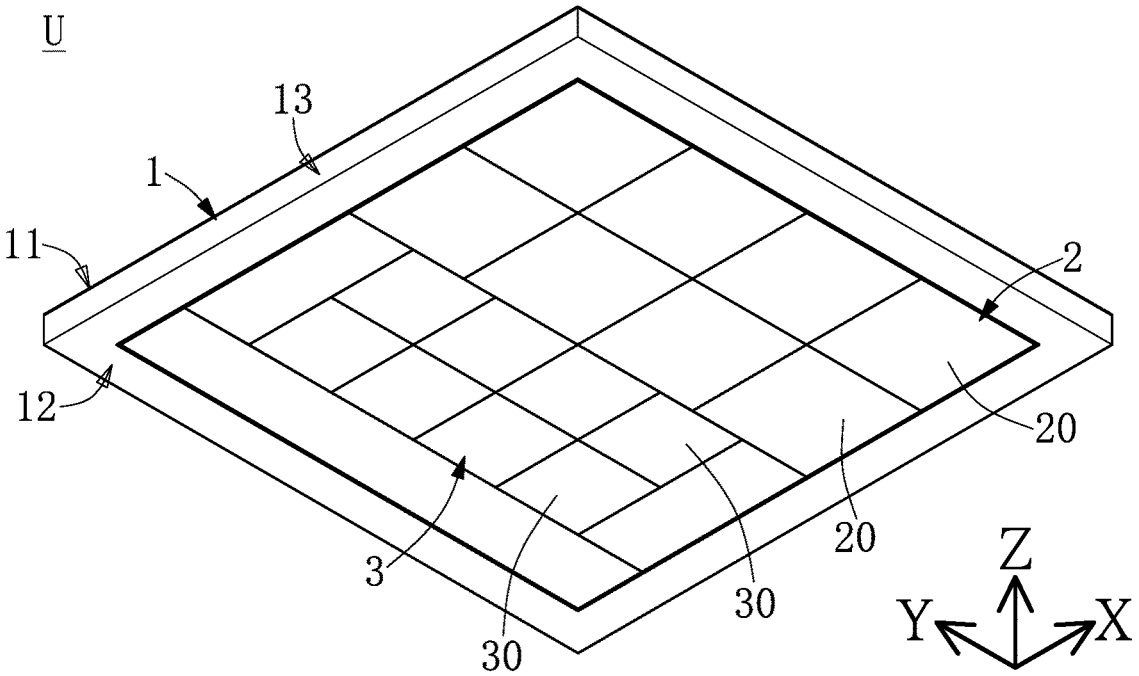
FIG. 2 is another perspective schematic view of the co-construction antenna module according to the first embodiment of the present disclosure.
Figure 3:
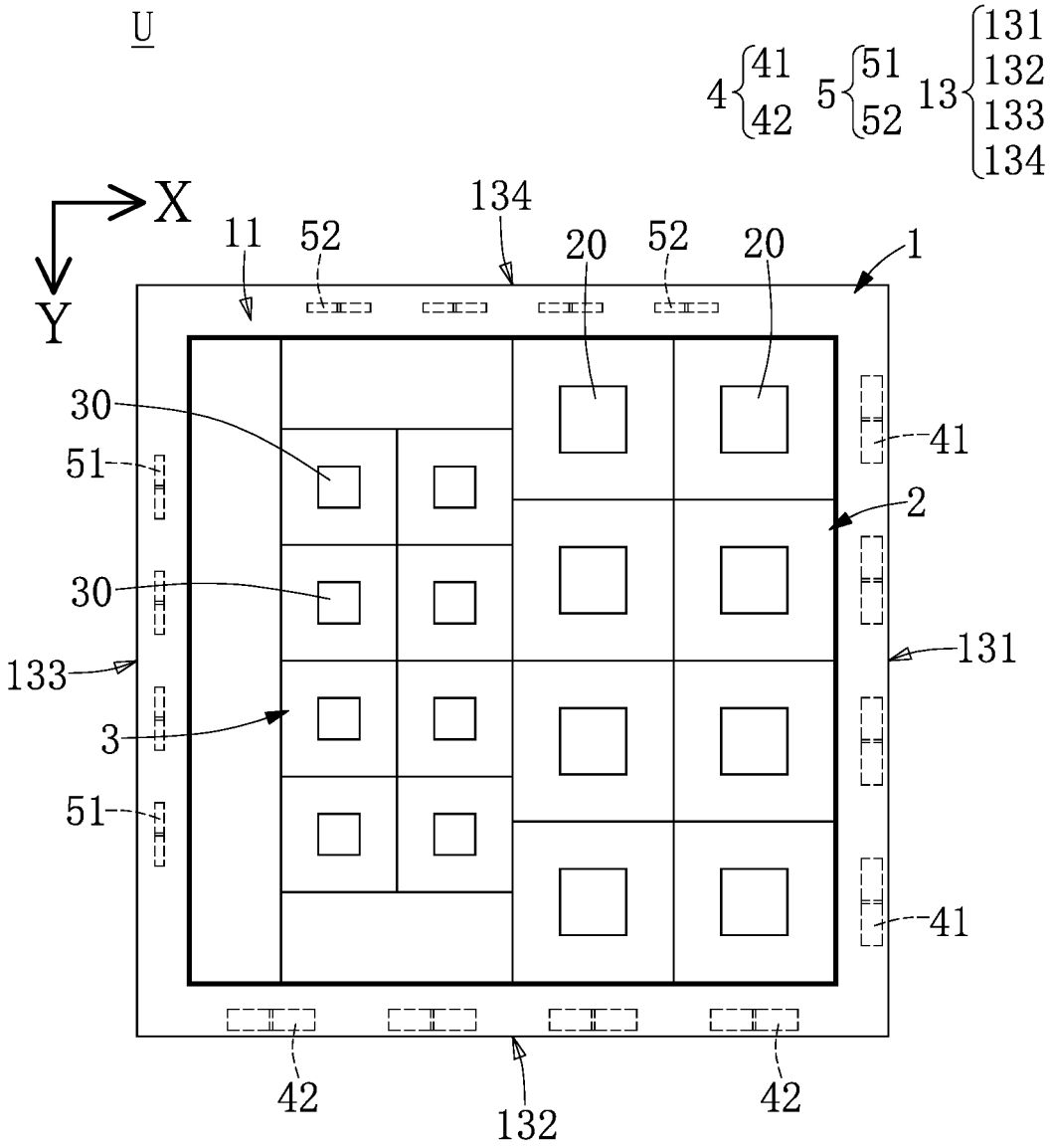
FIG. 3 is a top schematic view of a co-construction antenna module according to the first embodiment of the present disclosure.

Referring to FIG. 1 to FIG. 3, FIG. 1 is a perspective schematic view of a co-construction antenna module according to a first embodiment of the present disclosure, FIG. 2 is another perspective schematic view of the co-construction antenna module according to the first embodiment of the present disclosure, and FIG. 3 is a top schematic view of a co-construction antenna module according to the first embodiment of the present disclosure. The first embodiment of the present disclosure provides a co-construction antenna module U including: a carrier 1, a first patch antenna group 2, a second patch antenna group 3, a first dipole antenna group 4, and a second dipole antenna group 5. The carrier 1 can be a multilayer low temperature co-fired ceramic substrate (LTCC). In addition, in other embodiments, the carrier 1 may be a low dielectric constant and low loss PCB board, such as but not limited to a multilayer epoxy resin composed of a glass fiber substrate (FR-4). Thereby, the co-construction antenna module U provided by the present disclosure can co-construct the first patch antenna group 2, the second patch antenna group 3, the first dipole antenna group 4 and the second dipole antenna group 5 in the carrier 1 formed by the multi-layer low-temperature co-fired ceramic substrate by using a low-temperature co-fired ceramic technology. In other words, the first patch antenna group 2, the second patch antenna group 3, the first dipole antenna group 4, and the second dipole antenna group 5 can form an integrated co-fired ceramic antenna.

Next, referring to FIG. 1 and FIG. 2, the carrier 1 may include a first surface 11, a second surface 12 relative to the first surface 11, and a surrounding side 13 connected between the first surface 11 and the second surface 12. The first patch antenna group 2 may include a plurality of first patch antennas 20 disposed on the carrier 1, and the plurality of first patch antennas 20 are disposed on at least one of the first surface 11 and the second surface 12. The second patch antenna group 3 may include a plurality of second patch antennas 30 disposed on the carrier 1, and the plurality of second patch antennas 30 are disposed on at least one of the first surface 11 and the second surface 12. Further, in the first embodiment of the present disclosure, the plurality of first patch antennas 20 may be disposed on the first surface 11, and the plurality of second patch antennas 30 may be disposed on the first surface 11, but the present disclosure is not limited thereto. Thereby, since the first patch antenna 20 and the second patch antenna 30 in the first embodiment are all disposed on the first surface 11, a radiation pattern generated by the first patch antenna 20 and the second patch antenna 30 may formed along a Z direction.

Figure 4:
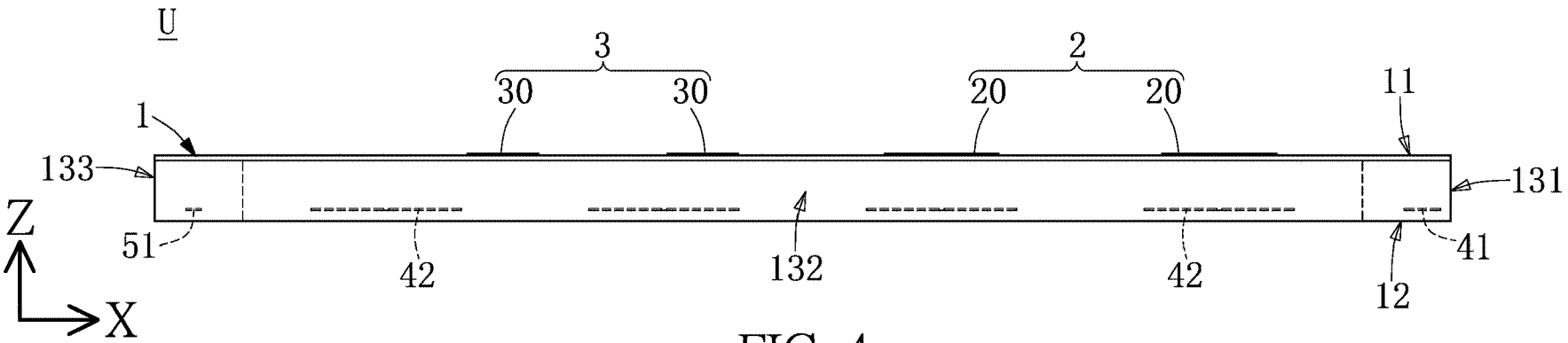
FIG. 4 is a side schematic view of a co-construction antenna module according to the first embodiment of the present disclosure.

Then, referring to FIG. 3 and FIG. 4, and FIG. 4 is a side schematic view of a co-construction antenna module according to the first embodiment of the present disclosure. The first dipole antenna group 4 can be disposed in the carrier 1, and the second dipole antenna group 5 can be disposed in the carrier 1. For example, when the carrier 1 is a multilayer low temperature co-fired ceramic substrate, the first dipole antenna group 4 and the second dipole antenna group 5 may be disposed on one of the layers of the low temperature co-fired ceramic substrate. Further, the first dipole antenna group 4 and the second dipole antenna group 5 may be located on the same layer of the low temperature co-fired ceramic substrate, or the first dipole antenna group 4 and the second dipole antenna group 5 are located on different layers of the low temperature co-fired ceramic substrate, and the present disclosure is not limited thereto. It should be noted that, in the embodiment of FIG. 4, the first dipole antenna group 4 and the second dipole antenna group 5 may be located on the same layer of the low temperature co-fired ceramic substrate.

As mentioned above, for example, the first dipole antenna group 4 may include a plurality of first dipole antennas 41 and a plurality of second dipole antennas 42, and the second dipole antenna group 5 may include a plurality of fourth dipole antennas 52. The plurality of first dipole antennas 41, the plurality of second dipole antennas 42, a plurality of third dipole antennas 51, and a plurality of fourth dipole antennas 52 may be disposed adjacent to the surrounding side 13 of the carrier 1. Further, the first patch antenna group 2 has a first operating band, the second patch antenna group 3 has a second operating band, the first dipole antenna group 4 has a third operating band, and the second dipole antenna group 5 has a fourth operating band. Further, the frequency of the first operating band may be less than the frequency of the second operating band, and the frequency of the third operating band may be less than the frequency of the fourth operating band. Furthermore, for example, the first operating band may be a millimeter-wave low-frequency, the second operating band may be a millimeter-wave high-frequency, the third operating band may be a millimeter-wave low-frequency, and the fourth operating band may be a millimeter-wave high-frequency. For example, in the present disclosure, the first patch antenna group 2 may have a first operating frequency band of 28 GHz, the second patch antenna group 3 may have a second operating frequency band of 39 GHz, the first dipole antenna group 4 may have a third operating frequency band of 28 GHz, and the second dipole antenna group 5 may have a fourth operating frequency band of 39 GHz, but the present disclosure is not limited thereto. Thereby, the patch antenna and the dipole antenna provided by the present disclosure can be applied to two different operating frequency bands, respectively.

Next, referring to FIG. 3, in the present disclosure, the first dipole antenna group 4 is closer to the surrounding side 13 than the first patch antenna group 2 or the second patch antenna group 3, and the second dipole antenna group 5 is closer to the surrounding side 13 than the first patch antenna group 2 or the second patch antenna group 3. In addition, a vertical projection of the first patch antenna group 2 on the second surface 12 of the carrier 1 can form a first projection area, a vertical projection of the second patch antenna group 3 on the second surface 12 of the carrier 1 can form a second projection area, a vertical projection of the first dipole antenna group 4 on the second surface 12 of the carrier 1 can form a third projection area, and a vertical projection of the second dipole antenna group 5 on the second surface 12 of the carrier 1 can form a fourth projection area. For example, the first projection area and the third projection area and/or the fourth projection area do not overlap each other, and the second projection area and the third projection area and/or the fourth projection area do not overlap each other, but the present disclosure is not limited thereto.

As mentioned above, referring to FIG. 3, for example, the surrounding side 13 of the carrier 1 may have a rectangular shape, and the surrounding side 13 may include a first side 131, a second side 132 connected to the first side 131, a third side 133 connected to the second side 132, and a fourth side 134 connected between the third side 133 and the first side 131. In the first embodiment of the present disclosure, the plurality of first dipole antennas 41 may be arranged along the first side 131, the plurality of second dipole antennas 42 may be arranged along the second side 132, the plurality of third dipole antennas 51 may be arranged along the third side 133, and the plurality of fourth dipole antennas 52 arranged along the fourth side 134.

Thereby, in the first embodiment of the present disclosure, the radiation pattern along the Z direction can be generated by the first patch antenna group 2 and the second patch antenna group 3, and a radiation pattern in the an X direction and a Y direction radiation can be generated by the first dipole antenna 41 and the second dipole antenna 42, respectively. A radiation pattern in a negative X direction and a negative Y direction can be generated by the third dipole antenna 51 and the fourth dipole antenna 52, respectively.

Figure 5:
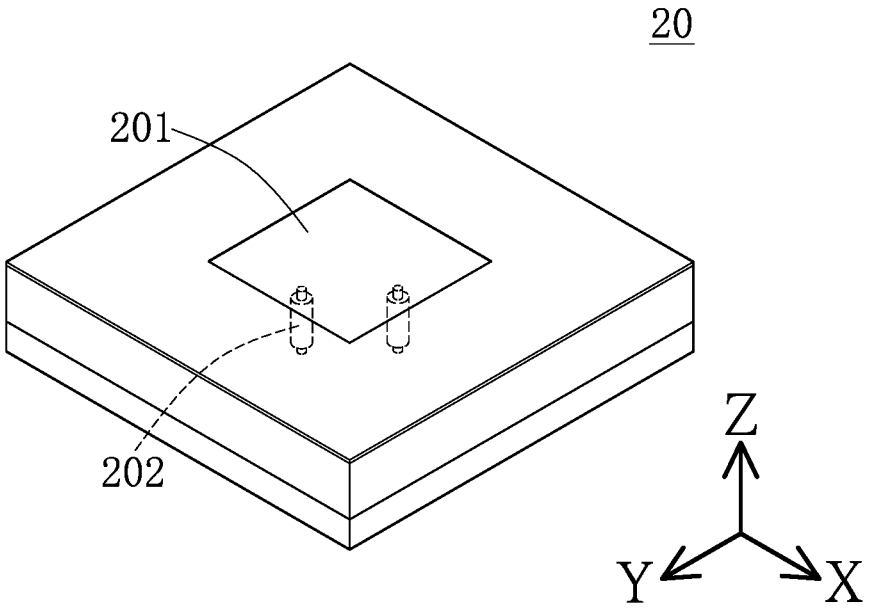
FIG. 5 is a perspective schematic view of a first patch antenna of the co-construction antenna module according to the first embodiment of the present disclosure.

Next, referring to FIG. 5, FIG. 5 is a perspective schematic view of a first patch antenna of the co-construction antenna module according to the first embodiment of the present disclosure. The first patch antenna 20 may include a first radiator 201 and a first feed pin 202 connected to the first radiator 201 to feed the signal to the first radiator 201 using the first feed pin 202. However, it should be noted that in the embodiment of FIG. 5, the first patch antenna 20 may include a first radiator 201 and two first feed pins 202 connected to the first radiator 201. The present disclosure is not limited thereto.

Figure 6:
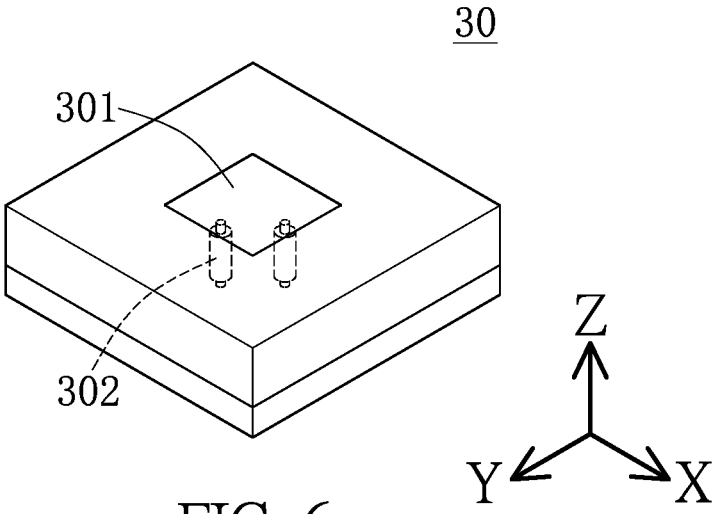
FIG. 6 is a perspective schematic view of a second patch antenna of the co-construction antenna module according to the first embodiment of the present disclosure.

Next, referring to FIG. 6, FIG. 6 is a perspective schematic view of a second patch antenna of the co-construction antenna module according to the first embodiment of the present disclosure. The second patch antenna 30 may include a second radiator and a second feed pin 302 connected to the second radiator 301 to feed the signal to the second radiator 301 by using the second feed pin 302. It should be noted that, in the embodiment of FIG. 6, the second patch antenna 30 may include a second radiator 301 and two second feed pins 302 connected to the second radiator 301. The present disclosure is not limited thereto.

Second Embodiment

Figure 7:
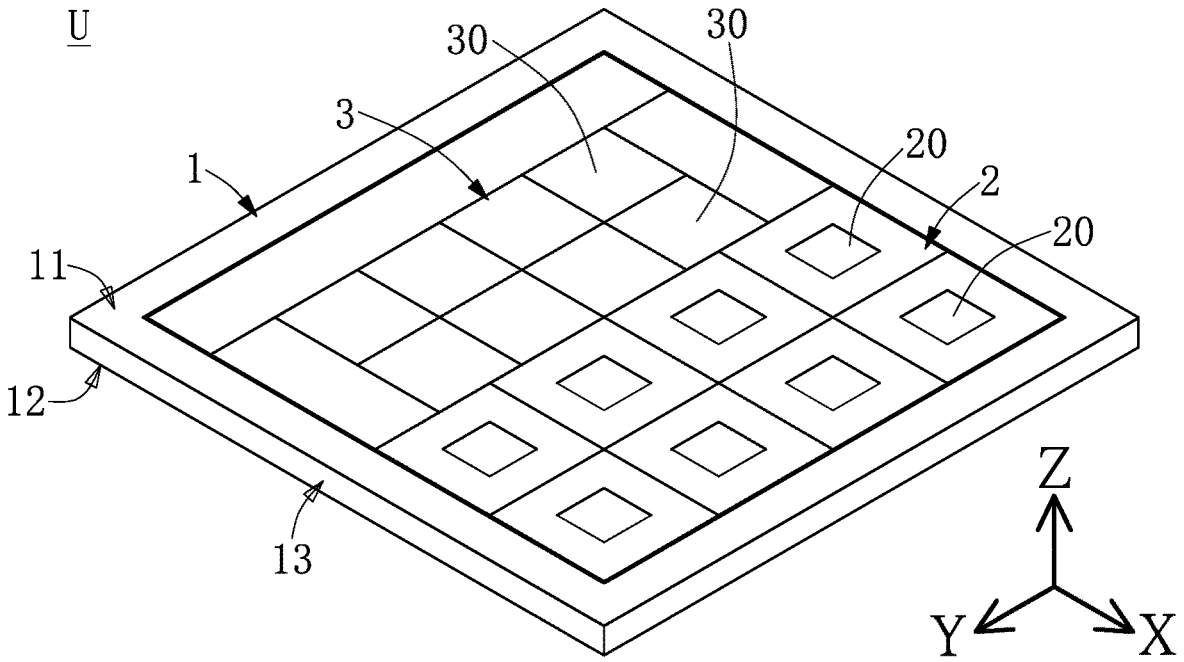
FIG. 7 is a perspective schematic view of a co-construction antenna module according to a second embodiment of the present disclosure.
Figure 8:
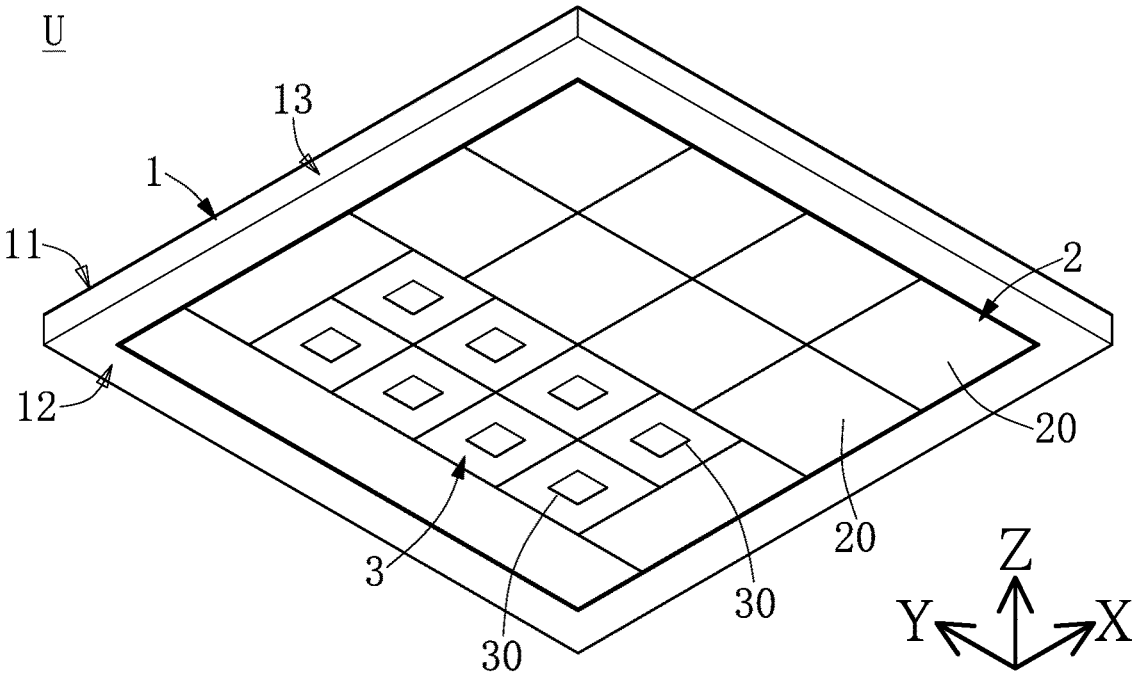
FIG. 8 is another perspective schematic view of the co-construction antenna module according to the second embodiment of the present disclosure.
Figure 9:
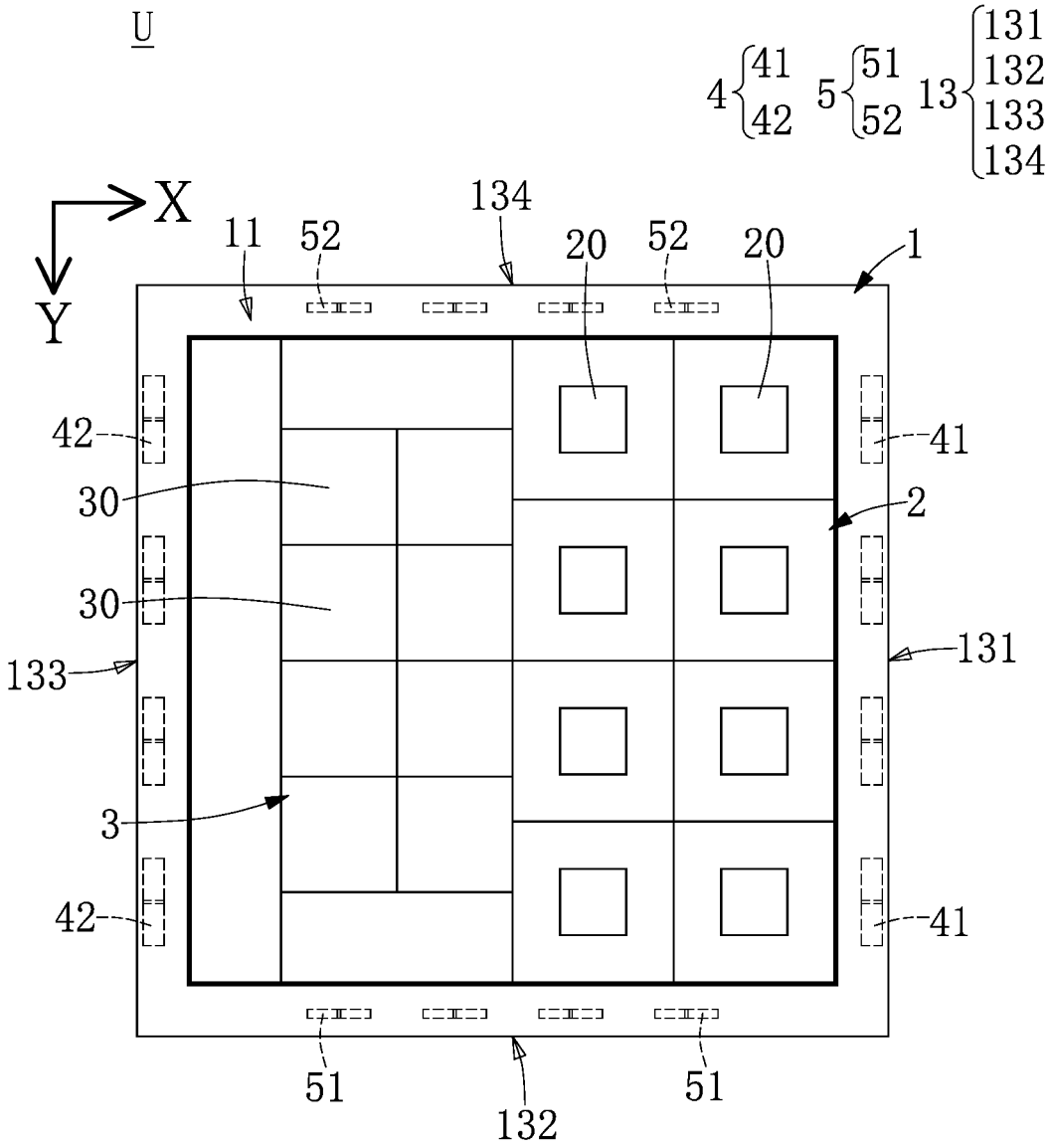
FIG. 9 is a top schematic view of a co-construction antenna module according to the second embodiment of the present disclosure.

Referring to FIG. 7 to FIG. 9, FIG. 7 is a perspective schematic view of a co-construction antenna module according to a second embodiment of the present disclosure, FIG. 8 is another perspective schematic view of the co-construction antenna module according to the second embodiment of the present disclosure, and FIG. 9 is a top schematic view of a co-construction antenna module according to the second embodiment of the present disclosure. The second embodiment of the present disclosure provides a co-construction antenna module U. However, it can be seen from a comparison of FIGS. 7 to 9 and FIGS. 1 to 3, the difference between the second embodiment of the present disclosure and the first embodiment is that configured positions of the first patch antenna group 2, the second patch antenna group 3, the first dipole antenna group 4, and/or the second dipole antenna group 5 of the co-construction antenna module U provided in the second embodiment are different. In addition, it should be noted that other structures of the co-construction antenna module U provided by the second embodiment are similar to the foregoing embodiments, and are not described herein again.

As mentioned above, referring to FIG. 9, in the second embodiment of the present disclosure, a plurality of first patch antennas 20 may be disposed on the first surface 11, and a plurality of second patch antennas 30 may be disposed on the second surface 12, but the present disclosure is not limited thereto. Therefore, since the first patch antenna 20 in the second embodiment is disposed on the first surface 11, and the second patch antenna 30 is disposed on the second surface 12, the radiation pattern generated by the first patch antenna 20 and the second patch antenna 30 may be formed along a Z direction. Further, in the second embodiment of the present disclosure, a plurality of first dipole antennas 41 may be arranged along a first side 131, a plurality of second dipole antennas 42 may be arranged along a third side 133, a plurality of third dipole antennas 51 may be arranged along a second side 132, and a plurality of fourth dipole antennas 52 can be arranged along a fourth side 134.

Thereby, in the second embodiment of the present disclosure, the radiation pattern along the Z direction can be generated by the first patch antenna group 2 and the second patch antenna group 3, and a radiation pattern along the an X direction and a negative X direction radiation can be generated by the first dipole antenna 41 and the second dipole antenna 42, respectively. A radiation pattern along a Y direction and a negative Y direction can be generated by the third dipole antenna 51 and the fourth dipole antenna 52, respectively.

Figure 10:
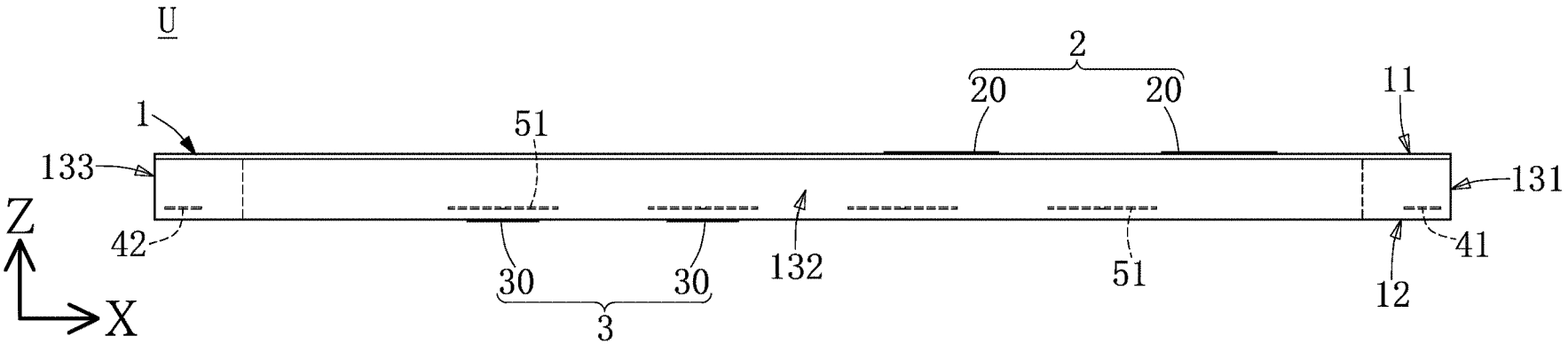
FIG. 10 is a side schematic view of a co-construction antenna module according to the second embodiment of the present disclosure.

Next, referring to FIG. 10, FIG. 10 is a side schematic view of a co-construction antenna module according to the second embodiment of the present disclosure. Further, in the embodiment of FIG. 10, the first dipole antenna group 4 and the second dipole antenna group 5 may be located on the same layer of the low temperature co-fired ceramic substrate, but the present disclosure is not limited thereto.

Third Embodiment

Figure 11:
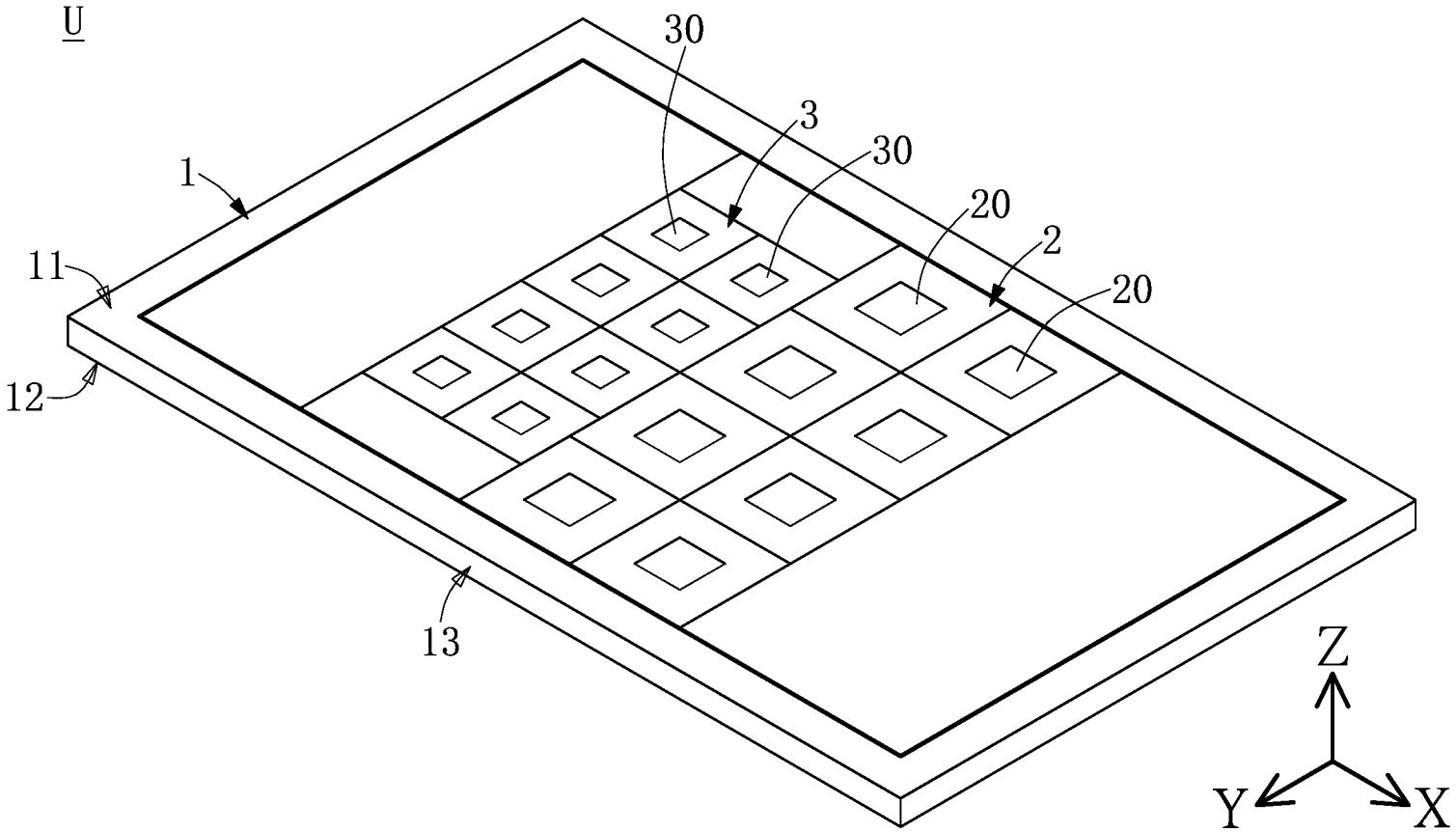
FIG. 11 is a perspective schematic view of a co-construction antenna module according to a third embodiment of the present disclosure.
Figure 12:
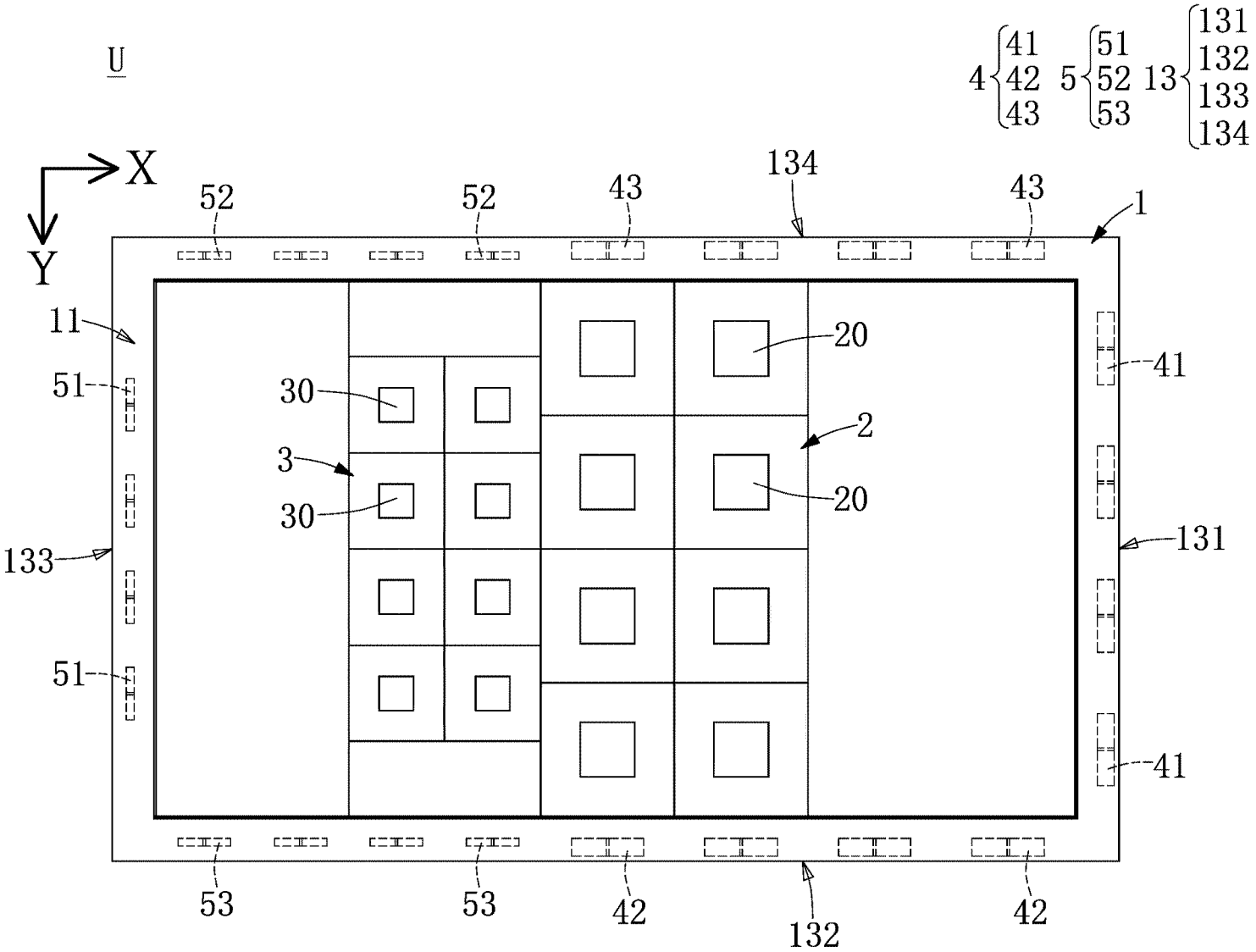
FIG. 12 is a top schematic view of a co-construction antenna module according to the third embodiment of the present disclosure.

Referring to FIG. 11 and FIG. 12, FIG. 11 is a perspective schematic view of a co-construction antenna module according to a third embodiment of the present disclosure, and FIG. 12 is a top schematic view of a co-construction antenna module according to the third embodiment of the present disclosure. The second embodiment of the present disclosure provides a co-construction antenna module U. However, it can be seen from a comparison of FIGS. 11 and 12 and FIGS. 1 to 3, the difference between the third embodiment of the present disclosure and the first embodiment is that configured positions of the first patch antenna group 2, the second patch antenna group 3, the first dipole antenna group 4, and/or the second dipole antenna group 5 of the co-construction antenna module U. In addition, it should be noted that other structures of the co-construction antenna module U provided by the third embodiment are similar to the foregoing embodiments, and are not described herein again. Further, in the third embodiment of the present disclosure, the first dipole antenna group 4 may further include a plurality of fifth dipole antennas, and the second dipole antenna group 5 may further include a plurality of sixth dipole antennas 53.

As mentioned above, referring to FIG. 12, in the third embodiment of the present disclosure, a plurality of first dipole antennas 41 may be arranged along the first side 131, a plurality of second dipole antennas 42 may be arranged along a second side 132, a plurality of fifth dipole antennas 43 may be arranged along a fourth side 134, a plurality of third dipole antennas 51 may be arranged along a third side 133, a plurality of fourth dipole antennas 52 may be arranged along the fourth side 134, and a plurality of six dipole antennas 53 may be arranged along the second side 132. In other words, by the arrangement of the fifth dipole antenna 43 and the sixth dipole antenna 53, a radiation pattern direction of the first dipole antenna group 4 and the second dipole antenna group 5 can be increased.

Thereby, in the third embodiment of the present disclosure, the radiation pattern along the Z direction can be generated by the first patch antenna group 2 and the second patch antenna group 3, and a radiation pattern in the an X direction, a Y direction, and a negative Y direction can be generated by the first dipole antenna 41, the second dipole antenna 42, and the fifth dipole antenna 43, respectively. A radiation pattern along the negative X direction, the Y direction, and the negative Y direction can be generated by the third dipole antenna 51, the fourth dipole antenna 52, and the sixth dipole antenna 53, respectively.

Figure 13:
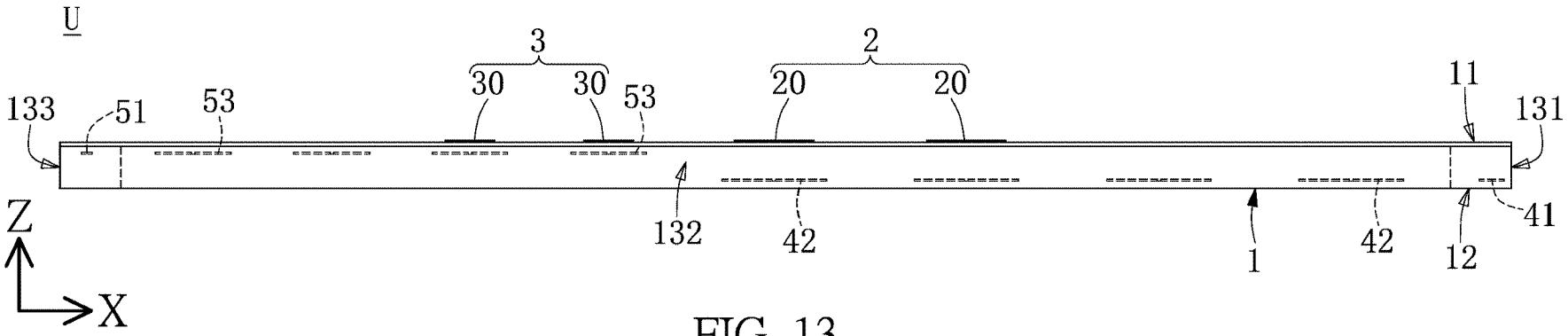
FIG. 13 is a side schematic view of a co-construction antenna module according to the third embodiment of the present disclosure.

Next, referring to FIG. 13, FIG. 13 is a side schematic view of a co-construction antenna module according to the third embodiment of the present disclosure. Further, in the embodiment of FIG. 13, the first dipole antenna group 4 and the second dipole antenna group 5 may be located on the same layer of the low temperature co-fired ceramic substrate, but the present disclosure is not limited thereto.

In conclusion, the co-construction antenna module U of the present disclosure has the technical features of "the plurality of first patch antennas 20 being disposed on at least one of the first surface 11 and the second surface 12," "the plurality of second patch antennas 30 being disposed on at least one of the first surface 11 and the second surface 12," and "the first dipole antenna group 4 being closer to the surrounding side 13 than the first patch antenna group 2 or the second patch antenna group 3, and the second dipole antenna group 5 being closer to the surrounding side 13 than the first patch antenna group 2 or the second patch antenna group 3" so as to improve the radiation efficiency of the co-construction antenna module U.

Further, the co-construction antenna module U provided by the present disclosure can co-construct the first patch antenna group 2, the second patch antenna group 3, the first dipole antenna group 4 and the second dipole antenna group 5 in the carrier 1 formed by the multi-layer low-temperature co-fired ceramic substrate by using the low-temperature co-fired ceramic technology and the carrier 1 being the low-temperature co-fired ceramic substrate. Therefore, the first patch antenna group 2, the second patch antenna group 3, the first dipole antenna group 4, and the second dipole antenna group 5 can form an integrated co-fired ceramic antenna. At the same time, the co-construction antenna module U can co-construct the millimeter-wave low-frequency and millimeter-wave high-frequency antennas under the same architecture, and is suitable for different frequency bands.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A co-construction antenna module, comprising:

a carrier including a first surface, a second surface relative to the first surface, and a surrounding side connected between the first surface and the second surface;

a first patch antenna group including a plurality of first patch antennas disposed on the carrier, wherein the plurality of first patch antennas are disposed on at least one of the first surface and the second surface; and a second patch antenna group including a plurality of second patch antennas disposed on the carrier, wherein the plurality of second patch antennas are disposed on at least one of the first surface and the second surface;

a first dipole antenna group disposed in the carrier; and a second dipole antenna group disposed in the carrier;

wherein the first dipole antenna group is closer to the surrounding side than the first patch antenna group or the second patch antenna group, and the second dipole antenna group is closer to the surrounding side than the first patch antenna group or the second patch antenna group.

2. The co-construction antenna module according to claim 1, wherein the first patch antenna group has a first operating band, the second patch antenna group has a second operating band, the first dipole antenna group has a third operating band, and the second dipole antenna group has a fourth operating band; wherein a frequency of the first operating band is less than a frequency of the second operating band, and a frequency of the third operating band is less than a frequency of the fourth operating band.

3. The co-construction antenna module according to claim 1, wherein the first dipole antenna group includes a plurality of first dipole antennas and a plurality of second dipole antennas, and the second dipole antenna group includes a third dipole antenna and a plurality of fourth dipole antennas; wherein the surrounding side is rectangular, and the surrounding side includes a first side, a second side connected to the first side, a third side connected to the second side, and a fourth side connected between the third side and the first side.

4. The co-construction antenna module according to claim 3, wherein a plurality of the first dipole antennas are arranged along the first side, a plurality of the second dipole antennas are arranged along the second side, a plurality of the third dipole antennas are arranged along the third side, and a plurality of the fourth dipole antennas are arranged along the fourth side.

5. The co-construction antenna module according to claim 3, wherein a plurality of the first dipole antennas are arranged along the first side, a plurality of the second dipole antennas are arranged along the third side, a plurality of the third dipole antennas are arranged along the second side, and a plurality of the fourth dipole antennas are arranged along the fourth side.

6. The co-construction antenna module according to claim 3, wherein the first dipole antenna group further includes a plurality of fifth dipole antenna groups, and the second dipole antenna group further includes a plurality of sixth dipole antennas, wherein the plurality of first dipole antennas are arranged along the first side, the plurality of second dipole antennas are arranged along the second side, the plurality of fifth dipole antennas are arranged along the fourth side, the plurality of third dipole antennas are arranged along the third side, the plurality of fourth dipole antennas are arranged along the fourth side, and the plurality of sixth dipole antennas are arranged along the second side.

7. The co-construction antenna module according to claim 1, wherein each of the first patch antennas includes a first radiator and a first feed pin connected to the first radiator, and each of the second patch antennas includes a second radiator and a second feed pin connected to the second radiator.

8. The co-construction antenna module according to claim 1, wherein the carrier is a low temperature co-fired ceramic substrate.

9. The co-construction antenna module according to claim 1, wherein the first dipole antenna group is located on the same layer as the second dipole antenna group.

10. The co-construction antenna module according to claim 1, wherein the first dipole antenna group and the second dipole antenna group are located on different layers.

* * * * *